US010120300B2

(12) United States Patent
Rosenstein et al.

(10) Patent No.: US 10,120,300 B2
(45) Date of Patent: Nov. 6, 2018

(54) BINARY INK DEVELOPER ASSEMBLY INCLUDING A GUARD MEMBER INCLUDING A CONFORMING END HAVING A CONCAVE SHAPE

(71) Applicant: HEWLETT-PACKARD INDIGO B.V., Amstelveen (NL)

(72) Inventors: Barak Rosenstein, Nes Ziona (IL); David Sabo, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/521,791

(22) PCT Filed: Jan. 13, 2015

(86) PCT No.: PCT/US2015/011098

§ 371 (c)(1),
(2) Date: Apr. 25, 2017

(87) PCT Pub. No.: WO2016/114757

PCT Pub. Date: Jul. 21, 2016

(65) Prior Publication Data

US 2017/0255126 A1 Sep. 7, 2017

(51) Int. Cl.

| | |
|---|---|
| ***G03G 15/08*** | (2006.01) |
| ***G03G 15/095*** | (2006.01) |
| ***G03G 15/11*** | (2006.01) |

(52) U.S. Cl.

CPC ..... *G03G 15/0877* (2013.01); *G03G 15/095* (2013.01); *G03G 15/11* (2013.01)

(58) Field of Classification Search

CPC ..... G03G 21/0088

See application file for complete search history.

(56) References Cited

U.S. PATENT DOCUMENTS

| | | | | |
|---|---|---|---|---|
| 3,651,782 | A * | 3/1972 | MacDonald, Jr. | G03G 15/104 137/205.5 |
| 7,356,287 | B2 * | 4/2008 | Guzman | G03G 15/104 399/237 |
| 7,522,865 | B2 | 4/2009 | Hasdai et al. | |
| 7,657,209 | B2 * | 2/2010 | Sabo | G03G 15/11 399/237 |
| 7,668,488 | B2 | 2/2010 | Guzman et al. | |
| 8,428,495 | B2 | 4/2013 | Li | |

(Continued)

OTHER PUBLICATIONS

Anthony, Thomas C., et al. "Ink Density Profile on Indigo Developer Roller." In NIP & Digital Fabrication Conference, vol. 2008, No. 2, pp. 581-584. Society for Imaging Science and Technology, 2008.

*Primary Examiner* — Victor Verbitsky

(74) *Attorney, Agent, or Firm* — HP Inc. Patent Department

(57) ABSTRACT

An example binary ink developer (BID) assembly includes a housing, a developer roller, a squeegee roller, and a guard member. The developer roller receives ink and transfers a portion of the ink to a photoconductive member. The squeegee roller rotates and regulates a film thickness of ink on the developer roller. The squeegee roller includes a curved circumference. The guard member includes a conforming end disposed across from the squeegee roller. Further, the conforming end has a concave shape corresponding to a portion of the curved circumference of the squeegee roller.

17 Claims, 5 Drawing Sheets

(56) References Cited

U.S. PATENT DOCUMENTS

| | | | | |
|---|---|---|---|---|
| 2006/0153597 | A1 | 7/2006 | Guzman et al. | |
| 2011/0074894 | A1 | 3/2011 | Sabo et al. | |
| 2012/0195644 | A1* | 8/2012 | Nelson ..... | G03G 15/0808 399/237 |
| 2013/0011162 | A1 | 1/2013 | Nelson et al. | |
| 2013/0149002 | A1 | 6/2013 | Karp et al. | |

* cited by examiner

BINARY INK DEVELOPER ASSEMBLY INCLUDING A GUARD MEMBER INCLUDING A CONFORMING END HAVING A CONCAVE SHAPE

CROSS-REFERENCE TO RELATED APPLICATION

This application is a U.S. National Stage Application of and claims priority to International Patent Application No. PCT/US2015/011098, filed on Jan. 13, 2015, and entitled "Binary Ink Developer Assembly Including a Guard Member Including a Conforming End Having a Concave Shape."

BACKGROUND

Printing systems such as liquid electro photographic printers include binary ink developer assemblies. The binary ink developer assemblies form images on a photoconductive member using liquid toner, and the like.

BRIEF DESCRIPTION OF THE DRAWINGS

For a detailed description of various examples, reference will nor be made to the accompanying drawings in which.

DETAIL DESCRIPTION

Printing systems such as liquid electro photographic (LEP) printers include binary ink developer (BID) assemblies. The binary ink developer assemblies utilize liquid toner (hereinafter ink) to form images. The flow of ink within and from the binary ink developer assembly to the photoconductive member may result in unintended ink splashes from the binary ink developer assemblies onto parts of the printing system. That is, the unintended ink splashes may land on and adhere to parts, of the printing system. For example, the ink may be redirected due to unintended sludge buildup causing a change in ink flow paths. Sludge buildup may form by ink undesirably flowing to and drying at unintended areas of the BID assembly. Over time, the buildup of such ink splashes may cause printer malfunctions and breakdowns. Accessing and cleaning the buildup of the ink splashes on the parts of the printing system by a user may require disassembling the printing system. Thus, the cleaning operation may be burdensome, time consuming, and costly.

In examples, a binary ink developer assembly is usable with a printing system. The binary ink developer (BID) assembly includes a housing, a developer roller, a squeegee roller, and a guard member. The housing may be in a form of an exterior portion of the BID assembly. The developer roller receives ink and transfers a portion of the ink to a photoconductive member. The squeegee roller rotates and regulates a film thickness of ink on the developer roller. The squeegee roller includes a curved circumference. The guard member includes a conforming end disposed across from the squeegee roller. Further, the conforming end has a concave shape corresponding to a portion of the curved circumference of the squeegee roller.

That's is, the respective curve shape of the conforming end of the guard member corresponding to the portion of the curved circumference of the squeegee roller disposed across therefrom, reduces an amount of ink from passing there between from one side of the guard member to another side of the guard member. For example, ink splashes exiting the housing may be prevented by the placement of the conforming end of the splash guard with respect to the rotating squeegee roller to reduce sludge accumulation at the other side of the guard member proximate to the housing. Accordingly, avoiding the improper flow of ink may reduce the formation of sludge buildup at unintended areas of the BID assembly. Thus, unintended ink splashes from the binary ink developer assemblies onto parts of the printing system and printer malfunctions due to ink splashes may be reduced.

Figure 1:
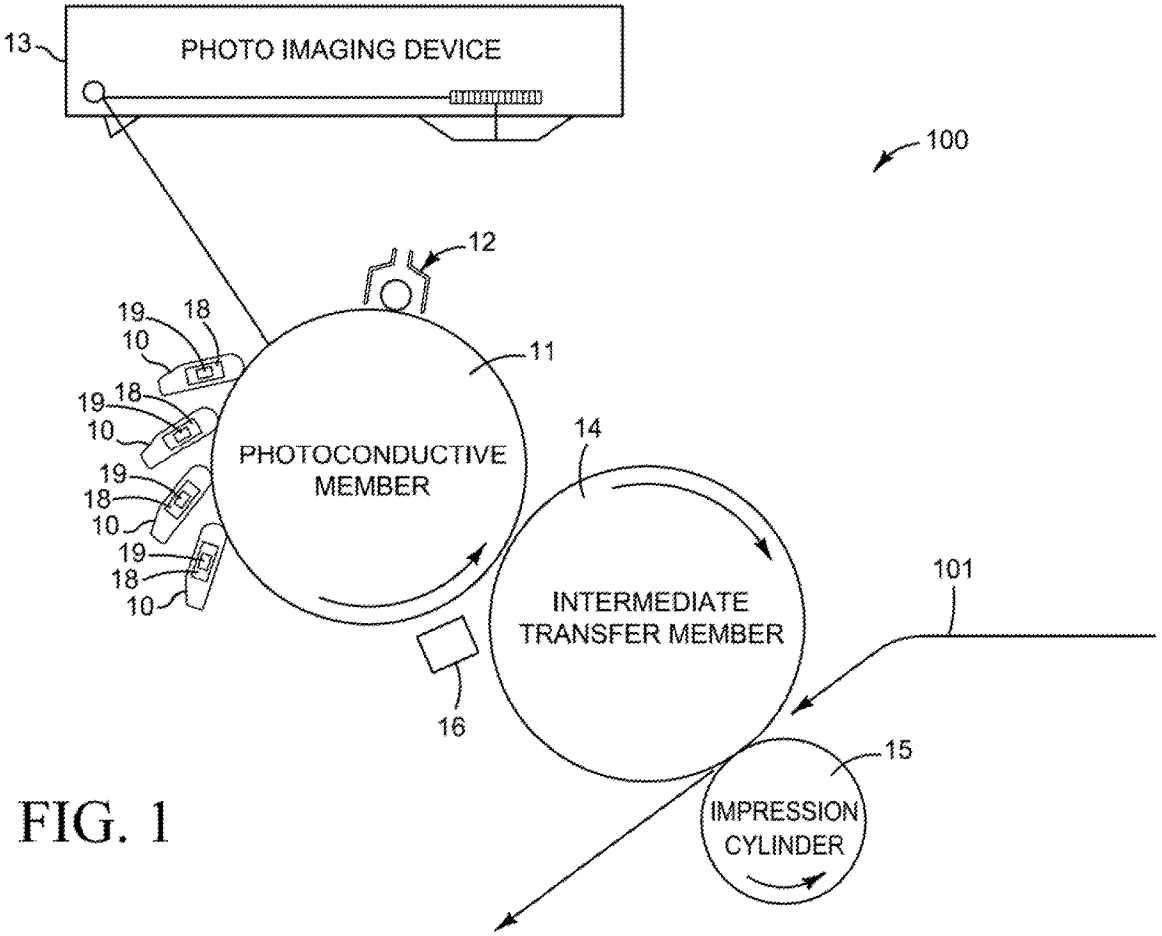
FIG. 1 is a schematic view illustrating a printing system according to an example.

FIG. 1 is a schematic view illustrating a printing system according to an example. Referring to FIG. 1, in some examples, a printing system 100 such as a liquid electro photographic (LEP) printer includes BID assemblies 10, a photoconductive member 11, a charging device 12, a photo imaging device 13, an intermediate transfer member (ITM) 14, an impression cylinder 15, and a discharging device 16. The BID assemblies 10 are disposed adjacent to the photoconductive member 11 and may correspond to various colors such as cyan, magenta, yellow, black, and the like. The BID assembly 10 includes, amongst other things, a guard member 18 including a conforming end 19 having a concave shape disposed across from a squeegee roller therein.

Referring to FIG. 1, in some examples, the charging device 12 applies a uniform electrostatic charge to a photoconductive surface such as the outer surface of the photoconductive member 11. A photo imaging device 13 such as a laser exposes selected areas on the photoconductive member 11 to light in a pattern of the desired printed image to dissipate the charge on the selected areas of photoconductive member 11 exposed to the light. For example, the discharged areas on the photoconductive member 11 form an electrostatic image which corresponds to the image to be printed. A thin layer of ink (e.g., liquid toner) is applied to the patterned photoconductive member 11 using the various BID assemblies 10 to form the latent image thereon.

Referring to FIG. 1, in some examples, the ink adheres to the discharged areas of the photoconductive member 11 in a uniform layer of ink (e.g., liquid toner) on the photoconductive member 11 and develops the latent electrostatic image into a toner image. The toner image is transferred from the photoconductive member 11 to the ITM 14. Subsequently, the toner image is transferred from the ITM 14 to the print medium 101 as the print medium 101 passes through an impression nip formed between the ITM 14 and the impression cylinder 15. The discharging device 16 removes residual charge from the photoconductive member 11.

Figure 2:
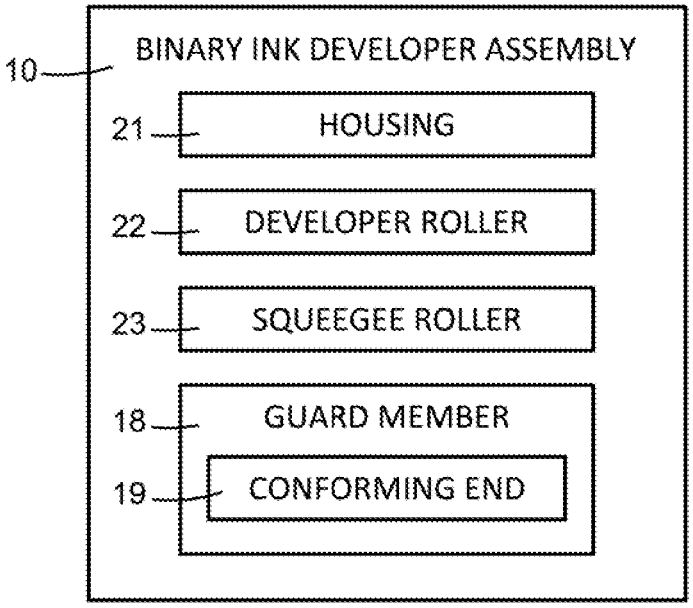
FIG. 2 is a block diagram illustrating a binary ink developer assembly of the printing system of FIG. 1 according to an example.

FIG. 2 is a block diagram illustrating a binary ink developer assembly of the printing system of FIG. 2 according to an example. The binary ink developer (BID) assembly 10 is usable with a printing system 100 (FIG. 1). The binary ink developer (BID) assembly 10 includes a housing 21, a developer roller 22, a squeegee roller 23, and a guard member 18. The housing 21 may include an exterior portion of the BID assembly 10 such as an enclosure. The developer roller 22 receives ink and transfers a portion of the ink to a photoconductive member 11 (FIG. 1), for example, of a printing system 100. The squeegee roller 23 rotates and regulates a film thickness of ink on the developer roller 22. The squeegee roller 23 includes a curved circumference. For example, in some examples, the squeegee roller 23 may have a circular circumference. Additionally, the squeegee roller 23 rotates in close proximity to the conforming end 19 of the guard member 18 and causes increased fluid resistance in the space between the conforming end 19 and a portion of the curved circumference of the squeegee roller 23 opposite thereof.

Referring to FIG. 2, the guard member 18 includes a conforming end 19 disposed across from the developer roller 22. Further, the conforming end 19 has a concave shape corresponding to a portion of the curved circumference of the squeegee roller 23. The respective curve shape of the conforming end 19 of the guard member 18 reduces an amount of ink on one side of the guard member 18 from passing between the conforming end 19 and the squeegee roller 23 to another side of the guard member 18. As a result, an ability for sludge to be accumulated at another side of the guard member 18 proximate to the housing 21 is reduced and, thus, not have ink be redirected to undesirably exit the housing 21. Thus, unintended ink splashes from the binary ink developer assemblies 10 onto parts of the printing system and printer malfunctions due to ink splashes may be reduced.

Figure 3:
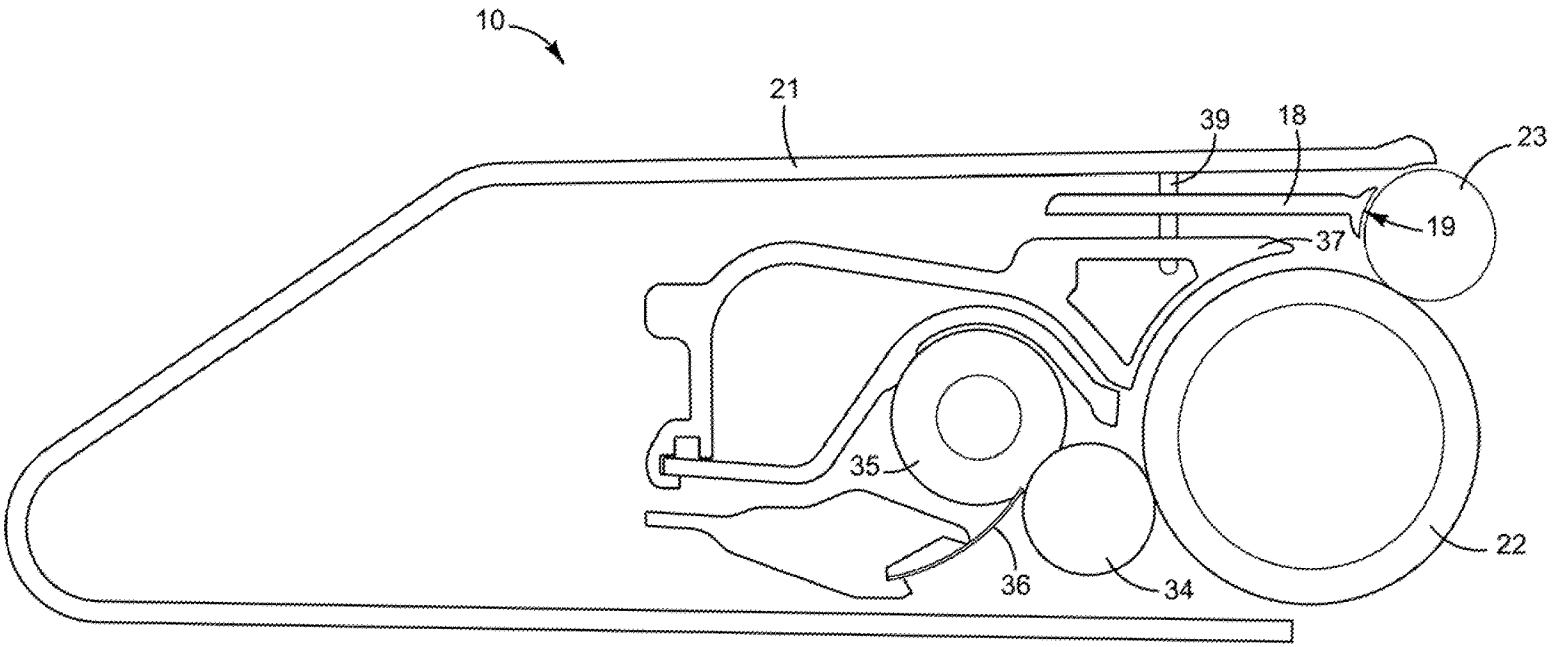
FIG. 3 is a schematic view illustrating a binary ink developer assembly according to an example.

FIG. 3 is a schematic view illustrating a binary ink developer assembly according to an example. In some examples, the BID assembly 10 includes the housing 21, the developer roller 22, the squeegee roller 23, and the guard member 18 previously described with respect to the BID assembly of FIG. 2. Referring to FIG. 3, in some examples, the BID assembly 10 includes a housing 21, a developer roller 22, a squeegee roller 23, a cleaner roller 34, a sponge roller 35, a wiper 36, a main electrode 37, and a guard member 18. The main electrode 37 creates a potential bias between itself and the developer roller 22 to transfer ink to the developer roller 22. The squeegee roller 23 regulates the film thickness of the ink on the developer roller 22.

Referring to FIG. 3, in some examples, ink is then selectively transferred from the developer roller 22 to the discharged portions of the surface of the photoconductive member 11 (FIG. 1). The cleaner roller 34 is disposed between and in contact with a developer roller 22 and a wiper 36. The cleaner roller 34 may rotate to clean the developer roller 22 and be cleaned by the wiper 36. For example, the cleaner roller 34 electrically removes remaining ink from the developer roller 22. The wiper 36 cleans the cleaner roller 34. The sponge roller 35 cleans the wiper 36. The guard member 18 includes a conforming end 19 disposed across from the developer roller 22. The conforming end 19 has a concave shape corresponding to a portion of the curved circumference of the squeegee roller 23. In some examples, the guard member 18 is coupled to at least one of the main electrode 37 and the housing 21. For example, the guard member 18 may be fastened to the main electrode 37 by a fastener 39. The guard member 18 may be an elongated, non, electrically-conductive member.

Figure 4:
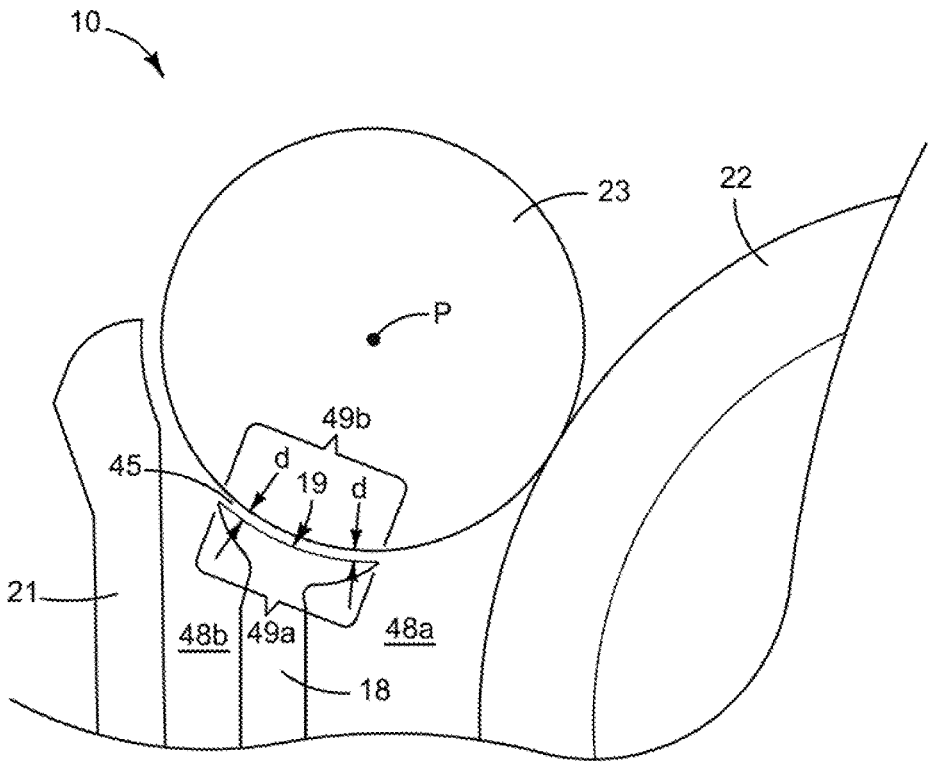
FIG. 4 is an exploded view illustrating a portion of the binary ink developer assembly of FIG. 3 according to an example.

FIG. 4 is an exploded view illustrating a portion of the binary ink developer assembly of FIG. 3 according to an example. Referring to FIG. 4, in some examples, the BID assembly 10 includes a space 45 formed between the conforming end 19 of the guard member 18 and a respective portion of the curved circumference of the squeegee roller 23 directly across therefrom. In some examples, the space 45 may be substantially uniform. That is, respective distances, d, at various points along the circumference of the conforming end 19 and corresponding points along the circumference of the squeegee roller 23 are substantially equal. In some examples, a distance, d, between the conforming end 19 of the guard member 18 and a respective portion of the curved circumference of the squeegee roller 23 directly across therefrom is in a range of 0.2 millimeters (mm) to 0.7 mm. In some examples, the guard member 18 is molded to enable precise alignment with respect to the squeegee roller 23. Additionally, in some examples, the guard member 18 is plastic.

Referring to FIG. 4, in some examples, the conforming end 19 of the guard member 18 has a concave shape corresponding to a portion of the curved circumference of the squeegee roller 23. In some examples, the concave shape of the conforming end 19 of the guard member 18 forms a first arc 49*a*. Additionally, in some examples, a portion of the curved circumference of the squeegee roller 23 forms a second arc 49*b* directly across from the first arc 49*a*. The first arc 49*a* and the second arc 49*b* may be concentric arcs. That is, a center point of the first and second arcs 49*a* and 49*b* may share a common center point, p. Further, the concave shape of the conforming end 19 of the guard member 18 corresponding to the portion of the curved circumference of the squeegee roller 23 and a rotation of the squeegee roller 23 are to reduce an amount of ink from one side 48*a* of the guard member 18 to pass there between to another side 48*b* of the guard member 18 to exit the housing 21.

The respective curve shape of the conforming end 19 of the guard member 18 reduces an amount of ink on one side 48*a* of the guard member 18 from passing between the conforming end and the squeegee roller 23 to another side 48*b* of the guard member 18. For example, the ink at one side 48*a* is at a higher pressure than another side 48*b* which is at atmospheric pressure. Further, by having a conforming end 19 with close spacing to the squeegee roller 23, the fluidic resistance through this space 45 is increased to reduce the pressure flow from one side 48*a* to another side 48*b*. Also, the counterclockwise rotation of the squeegee roller 23 acts as a viscous pump that pulls the ink back towards one side 48*a*. As a result, an ability of such ink to undesirably leave the housing 21 is reduced. Thus, unintended ink splashes from the binary ink developer assemblies 10 onto parts of the printing system and printer malfunctions due to ink splashes may be reduced.

Figure 5:
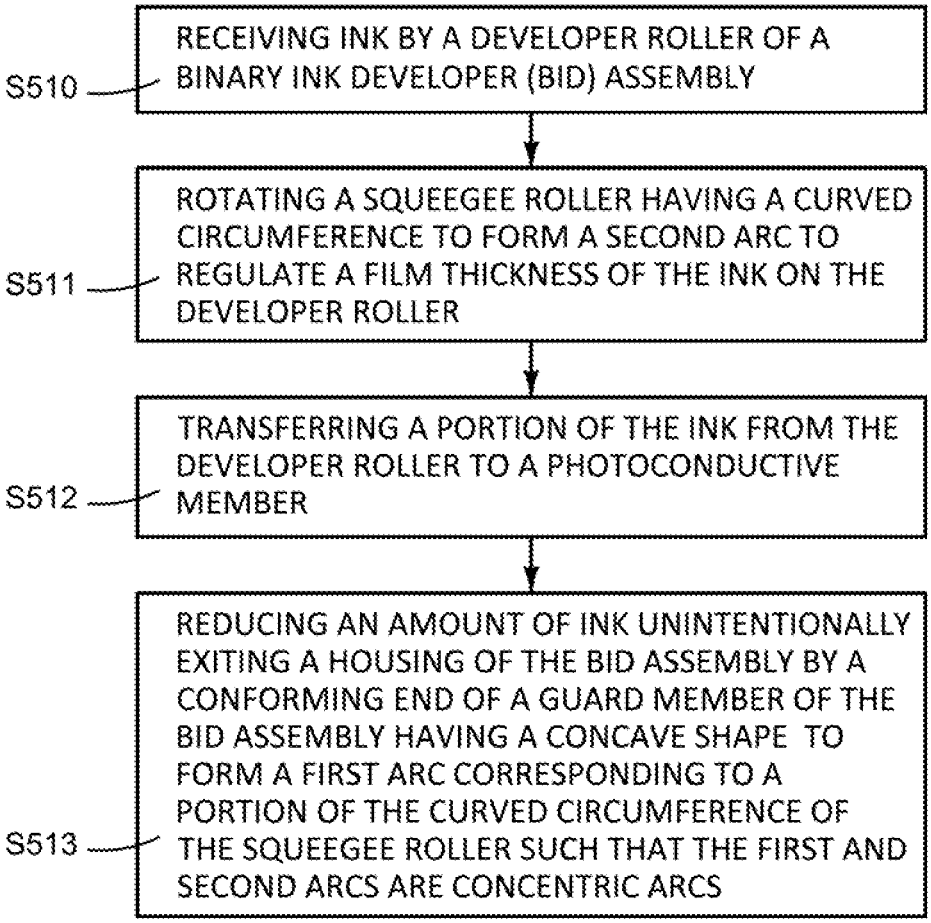
FIG. 5 is a flowchart illustrating a method of operating a binary ink developer assembly according to an example.

FIG. 5 is a flowchart illustrating a method of operating a binary ink developer assembly according to an example. In some examples, the members, assemblies, and the like, previously discussed with respect to FIGS. 1-4 may be used to implement the method of operating a binary ink developer assembly of FIG. 5. In block S510, ink is received by a developer roller of the binary ink developer (BID) assembly. In block S511, a squeegee roller having a curved circumference to form a second arc is rotated to regulate a film thickness of the ink on the developer roller. In block S512, a portion of the ink is transferred from the developer roller to a photoconductive member.

In block S513, an amount of ink unintentionally exiting a housing of the BID assembly is reduced by a conforming end of a guard member of the BID assembly having a concave shape in a form of a first arc corresponding to a portion of the curved circumference of the squeegee roller in a form of a second arc such that the first and second arcs are concentric arcs. For example, an amount of ink moving from one side to another side of the guard member between the conforming end and the squeegee roller is reduced. That is, the ink at one side of the guard member is at higher pressure than another side of the guard member which is at atmospheric pressure. Further, by having a conforming end with close spacing to the squeegee roller, the fluidic resistance through the space is increased to reduce the pressure flow from one side to another side. Also, the counterclockwise rotation of the squeegee roller acts as a viscous pump that pulls the ink back towards one side. That is, the first and second concentric arcs share a common center point.

In some examples, the method may also include maintaining a substantially uniform space between the conforming end of the guard member and a respective portion of the curved circumference of the squeegee roller directly across therefrom. The method may also include creating a potential bias with the developer roller by a main electrode to transfer the ink to the developer roller. The method may also include rotating a cleaner roller in contact with the developer roller to clean the developer roller. The method may also include cleaning the cleaner roller by a wiper in contact therewith during a rotation of the cleaner roller. The method may also include rotating a sponge roller in contact with a wiper to clean the wiper.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be rearranged relative to the order illustrated. Also, two or more blocks illustrated in succession in FIG. 5 may be executed concurrently or with partial concurrence. All such variations are within the scope of the present disclosure.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A binary ink developer assembly usable with a printing system, the binary ink developer assembly comprising:

a housing;

a developer roller to receive ink and transfer a portion of the ink to a photoconductive member;

a squeegee roller to rotate and regulate a film thickness of ink on the developer roller, the squeegee roller including a curved circumference; and a non-electrically conductive guard member including a conforming end disposed across from the squeegee roller, the conforming end having a concave shape corresponding to a portion of the curved circumference of the squeegee roller, wherein a space formed between the conforming end having the concave shape and the portion of the curved circumference of the squeegee roller is located between the housing and the developer roller, a first region on a first side of the guard member located between the housing and the conforming end, and a second region on a second side of the guard member located between the conforming end and the developer roller, the squeegee roller to rotate in a direction to viscously pump ink towards the second region.

2. The binary ink developer assembly of claim 1, wherein the concave shape of the conforming end of the guard member forms a first arc and the portion of the curved circumference of the squeegee roller forms a second arc directly across from the first arc such that the first arc and the second arc are concentric arcs.

3. The binary ink developer assembly of claim 1, wherein the space formed between the conforming end of the guard member and the portion of the curved circumference of the squeegee roller directly across the conforming end is substantially uniform.

4. The binary ink developer assembly of claim 1, wherein a distance between the conforming end of the guard member and the portion of the curved circumference of the squeegee roller directly across the conforming end is in a range of 0.2 millimeter (mm) to 0.7 mm.

5. The binary ink developer assembly of claim 1, wherein the concave shape of the conforming end of the guard member corresponding to the portion of the curved circumference of the squeegee roller and a rotation of the squeegee roller are to reduce an amount of ink from the second side of the guard member to pass through the space between the guard member and the squeegee roller to the first side of the guard member.

6. The binary ink developer assembly of claim 1, further comprising:

a main electrode coupled to the guard member to create a potential bias with the developer roller to transfer the ink to the developer roller.

7. The binary ink developer assembly of claim 1, wherein the guard member is coupled to the housing.

8. The binary ink developer assembly of claim 1, further comprising:

a cleaner roller in contact with the developer roller, the cleaner roller to rotate to clean the developer roller.

9. The binary ink developer assembly of claim 8, further comprising:

a wiper in contact with the cleaner roller, the wiper to clean the cleaner roller during a rotation of the cleaner roller.

10. The binary ink developer assembly of claim 9, further comprising:

a sponge roller in contact with the wiper, the sponge roller to clean the wiper.

11. The binary ink developer assembly of claim 1, wherein the space extends between the first region and the second region, and the viscous pumping of the ink towards the second region by the rotating of the squeegee roller in the direction reduces ink flow through the space from the second region to the first region.

12. A method of operating a binary ink developer (BID) assembly, the method comprising:

receiving ink by a developer roller of the BID assembly;

rotating a squeegee roller having a curved circumference forming a second arc to regulate a film thickness of the ink on the developer roller as the developer roller rotates;

transferring a portion of the ink from the developer roller to a photoconductive member; and reducing an amount of ink unintentionally exiting a housing of the BID assembly by a conforming end of a non-electrically conductive guard member of the BID assembly having a concave shape forming a first arc corresponding to a portion of the curved circumference of the squeegee roller such that the first arc and the second arc are concentric arcs, wherein a space formed between the first arc of the conforming end of the guard member and the second arc of the curved circumference of the squeegee roller is located between the housing and the developer roller, a first region on a first side of the guard member located between the housing and the conforming end, and a second region on a second side of the guard member located between the conforming end and the developer roller, and the space extending between the first region and the second region, wherein the squeegee roller rotates in a direction to viscously pump ink towards the second region.

13. The method of claim 12, wherein the reducing the amount of ink unintentionally exiting the housing of the BID assembly comprises:

reducing an amount of ink moving from the second region to the first region through the space between the conforming end and the squeegee roller.

14. The method of claim 12, further comprising:

maintaining a substantially uniform space between the conforming end of the guard member and a respective portion of the curved circumference of the squeegee roller directly across from the conforming end.

15. The method of claim 12, further comprising:

creating a potential bias with the developer roller by a main electrode to transfer the ink to the developer roller;

rotating a cleaner roller in contact with the developer roller to clean the developer roller;

cleaning the cleaner roller by a wiper in contact with the cleaner roller during a rotation of the cleaner roller; and rotating a sponge roller in contact with the wiper to clean the wiper.

16. The method of claim 15, wherein the guard member is coupled to the main electrode.

17. A binary ink developer assembly usable with a printing system, the binary ink developer assembly comprising:

a housing;

a developer roller to receive ink and transfer a portion of the ink to a photoconductive member;

a squeegee roller to rotate and regulate a film thickness of ink on the developer roller as the developer roller rotates, the squeegee roller including a curved circumference; and a non-electrically conductive guard member including a conforming end disposed across from the squeegee roller, the conforming end having a concave shape corresponding to a portion of the curved circumference of the squeegee roller, wherein a space formed between the conforming end having the concave shape and the portion of the curved circumference of the squeegee roller directly across the conforming end is located between the housing and the developer roller, a first region on a first side of the guard member located between the housing and the conforming end, and a second region on a second side of the guard member located between the conforming end and the developer roller, the space extending between the first region and the second region, the squeegee roller to rotate in a direction to keep ink in the second region and away from the first region.

* * * * *